US008285549B2

(12) United States Patent
Teegan et al.

(10) Patent No.: US 8,285,549 B2
(45) **Date of Patent: *Oct. 9, 2012**

(54) PERSONALITY-BASED DEVICE

(75) Inventors: Hugh A. Teegan, Bellevue, WA (US); Eric N. Badger, Issaquah, WA (US); Drew E. Linerud, Duvall, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/404,048

(22) Filed: Feb. 24, 2012

(65) Prior Publication Data

US 2012/0150543 A1 Jun. 14, 2012

Related U.S. Application Data

(63) Continuation of application No. 11/752,989, filed on May 24, 2007, now Pat. No. 8,131,549.

(51) Int. Cl.
*G10L 13/08* (2006.01)

(52) U.S. Cl. ..... 704/260

(58) Field of Classification Search ..... 704/260
See application file for complete search history.

(56) References Cited

U.S. PATENT DOCUMENTS

| | | | |
|---|---|---|---|
| 5,327,521 | A | 7/1994 | Savic et al. |
| 6,336,092 | B1 | 1/2002 | Gibson et al. |
| 6,615,174 | B1 | 9/2003 | Arslan et al. |
| 6,810,378 | B2 | 10/2004 | Kochanski et al. |
| 6,964,023 | B2 | 11/2005 | Maes et al. |
| 7,137,126 | B1 | 11/2006 | Coffman et al. |
| 7,149,682 | B2 | 12/2006 | Yoshioka et al. |
| 7,191,132 | B2 | 3/2007 | Brittan et al. |
| 7,483,832 | B2 | 1/2009 | Tischer |
| 7,606,709 | B2 | 10/2009 | Yoshioka et al. |
| 7,693,717 | B2 | 4/2010 | Kahn et al. |
| 7,729,916 | B2 | 6/2010 | Coffman et al. |
| 8,131,549 | B2 | 3/2012 | Teegan et al. |
| 2002/0010584 | A1 | 1/2002 | Schultz et al. |
| 2002/0120450 | A1 | 8/2002 | Junqua et al. |
| 2003/0028380 | A1 | 2/2003 | Freeland et al. |
| 2004/0018863 | A1 | 1/2004 | Engstrom et al. |
| 2004/0098266 | A1 | 5/2004 | Hughes et al. |
| 2004/0148176 | A1 | 7/2004 | Scholl |
| 2005/0037746 | A1 | 2/2005 | Ramalho et al. |
| 2005/0086328 | A1 | 4/2005 | Landram et al. |
| 2005/0203729 | A1 | 9/2005 | Roth et al. |
| 2006/0069567 | A1 | 3/2006 | Tischer et al. |
| 2006/0129399 | A1 | 6/2006 | Turk et al. |

(Continued)

FOREIGN PATENT DOCUMENTS

| | | | |
|---|---|---|---|
| EP | 1 271 469 | A1 | 1/2003 |
| JP | 2003-337592 | | 11/2003 |
| WO | WO 2004/032112 | A1 | 4/2004 |

OTHER PUBLICATIONS

European Office Action dated Feb. 21, 2012 cited in Application No. 08 769 518.5, 4 pgs.

(Continued)

*Primary Examiner* — Talivaldis Ivars Smits
(74) *Attorney, Agent, or Firm* — Merchant & Gould

(57) ABSTRACT

A personality-based theme may be provided. A prompt and an input indicating a personality may be received. Next, a voice font corresponding to the personality may be determined. The voice font may then be applied to the received prompt by augmenting the voice font applied prompt with recorded phrases of the personality.

20 Claims, 4 Drawing Sheets

U.S. PATENT DOCUMENTS

| | | | |
|---|---|---|---|
| 2006/0173911 | A1 | 8/2006 | Levin et al. |
| 2006/0253286 | A1 | 11/2006 | Akabane et al. |
| 2007/0011009 | A1 | 1/2007 | Nurminen et al. |
| 2007/0213987 | A1 | 9/2007 | Turk et al. |
| 2008/0082320 | A1 | 4/2008 | Popa et al. |
| 2008/0291325 | A1 | 11/2008 | Teegan et al. |

OTHER PUBLICATIONS

E. Krahmer et al., "Audio-visual Personality Cues for Embodied Agents: An experimental evaluation," 7 pgs., http://www.vhml.org/workshops/aamas2003/papers/kramher/kramher.pdf.

M. Wagner et al., "From personal mobility to mobile personality," pp. 155-164, Telektronikk 3/4.2005, http://www.telenor.com/telektronikk/volumes/pdf/3_4.2005/Page_155-164.pdf.

International Search Report dated Oct. 30, 2008 cited in International Application No. PCT/US2008/064151.

Chinese First Office Action dated Feb. 22, 2011 cited in Application No. 200880017283.3.

European Supplemental Search Report dated Sep. 15, 2011 cited in Application No. 08769518.5.

Australian First Report dated Apr. 20, 2012 cited in Application No. 2008256989, 2 pgs.

Israeli Official Notification dated Jul. 11, 2012 cited in Appl. No. 201652, 6 pgs.

PERSONALITY-BASED DEVICE

RELATED APPLICATION

This application is a Continuation of co-pending U.S. application Ser. No. 11/752,989 entitled "Personality-Based Device" filed May 24, 2007, which is incorporated herein by reference.

BACKGROUND

A mobile device may be used as a principal computing device for many activities. For example, the mobile device may comprise a handheld computer for managing contacts, appointments, and tasks. A mobile device typically includes a name and address database, calendar, to-do list, and note taker, which may include these functions in a personal information manager. Wireless mobile devices may also offer e-mail, Web browsing, and cellular telephone service (e.g. a smartphone). Data may be synchronized between the mobile device and a desktop computer via a cabled connection or a wireless connection.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

A personality-based theme may be provided. An application program may query a personality resource file for a prompt corresponding to a personality. Then the prompt may be received at a speech synthesis engine. Next, the speech synthesis engine may query a personality voice font database for a voice font corresponding to the personality. Then the speech synthesis engine may apply the voice font to the prompt. The voice font applied prompt may then be produced at an output device.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1:
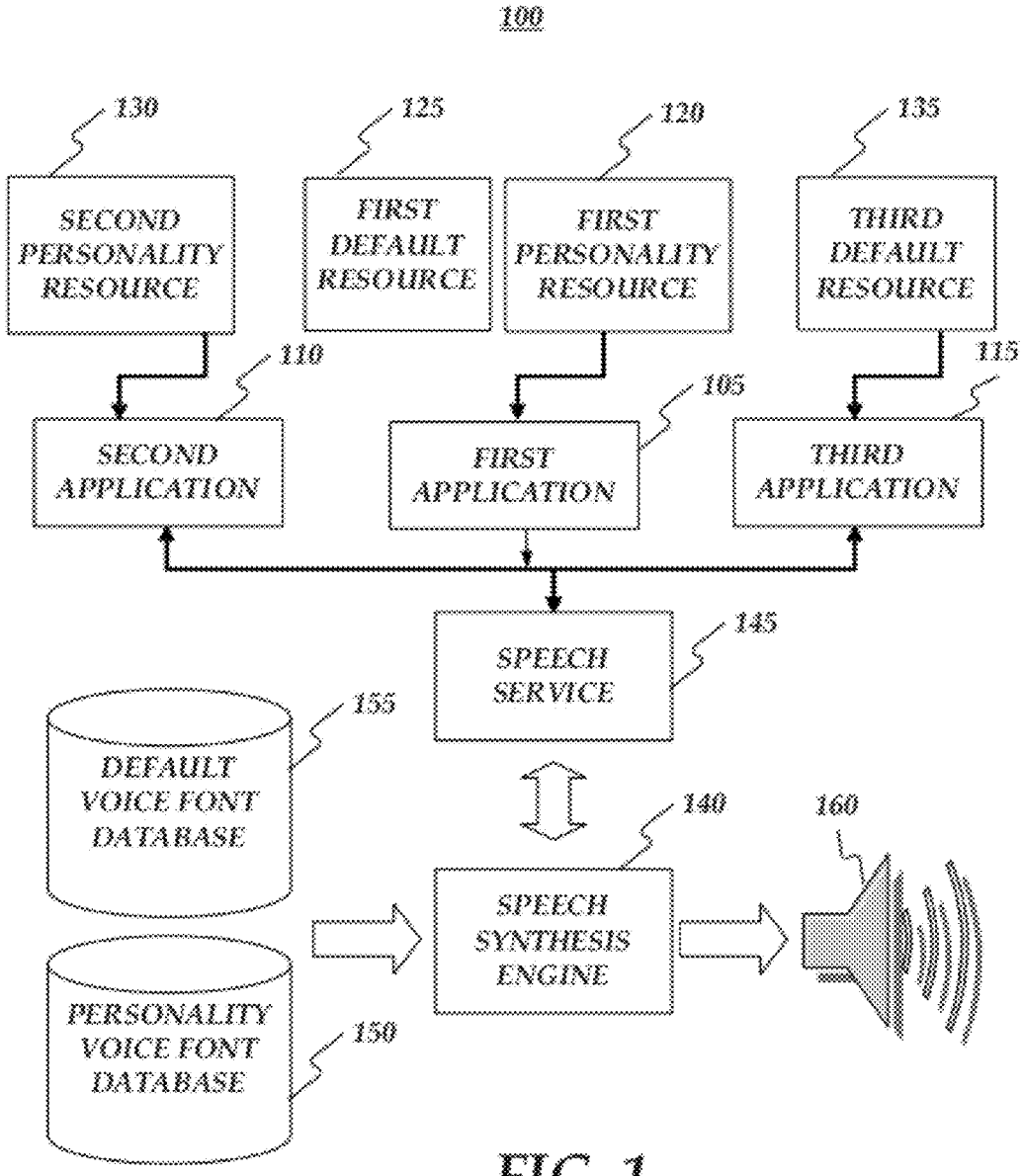
FIG. 1 is a block diagram of an operating environment.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention. Instead, the proper scope of the invention is defined by the appended claims.

Embodiments of the invention may increase a device's (e.g. a mobile device or embedded device) appeal through personality theme incorporation. The personality may be an individual's personality and may be a celebrity figure's personality. To provide this personality theme, embodiments of the invention may use synthesized speech, music, and visual elements. Moreover, embodiments of the invention may provide a device that portrays a single personality or even multiple personalities.

Consistent with embodiments of the invention, speech synthesis may portray a target individual (e.g. the personality) through using a "voice font" generated, for example, from recordings made by the target individual or individuals. This voice font may allow the device to sound like a specific individual when the device "speaks." In other words, the voice font may allow the device to produce a customized voice. In addition to the customized voice, message prompts may be customized to reflect the target individual's grammatical style. In addition, the synthesized speech may also be augmented by recorded phrases or messages from the target individual.

Furthermore, music may be used by the device to portray the target individual. In the case where the target individual is a musical artist, for example, songs by the target individual may be used for ring tones, notifications, etc., for example. Songs by the target individual may also be included with the personality theme for devices with media capabilities. Devices portraying actors as the target individual could use theme music from movies or television shows where the actor appeared.

Visual elements within the personality theme may include, for example, target individual images, objects associated with the target individual, and color themes that end-users might identify with the target individual or with the target individual's work. An example may be the image of a football for a "Shawn Alexander phone." The visual elements could appear in the background on the mobile device's screen, in window borders, on some icons, or event printed on the phone exterior (possibly on a removable faceplate).

Accordingly, embodiments of the invention may customize a personality theme for a device around one or more personalities, possibly a celebrity (the "personality skin") to provide a "personality skin package" used to deliver the personality theme. For example, embodiments of the invention may grammatically alter standard prompts to match the target individual's speaking style. Moreover, embodiments of the invention may include a "personality skin manager" that may allow users to switch between personality skins, remove personality skin packages, or download new personality skin packages, for example.

A "personality skin" may comprise, for example: i) a customized voice font generated from recordings from the target individual; ii) speech prompts customized to match a speaking style of the target individual; iii) personality-specific audio clips or files; and iv) personality-specific images or other visual elements. Where these elements (or others) are delivered together in a single package, they may be referred to as a personality skin package.

FIG. 1 shows a personality-based theme system 100. As shown in FIG. 1, system 100 may include a first application program 105, a second application program 110, a third application program 115, a first personality resource file 120, a first default resource file 125, a second personality resource file 130, and a third default resource file 135. In addition, system 100 may include a speech synthesis engine 140, a personality voice font database 150, a default voice font database 155, and an output device 160. Any of first application program 105, second application program 110, or third application program 115 may comprise, but not limited to, any of electronic mail and contacts applications, word processing applications, spreadsheet applications, database applications, slide presentation applications, drawing or computer-aided application programs, etc. Output device 160 may, for example, comprise any of output devices 414 as described in more detail below with respect to FIG. 4. As described in greater detail below with respect to FIG. 4, system 100 may be implemented using system 400. Furthermore, as described in greater detail below, system 100 may be used to implement one or more of method 300's stages as described in greater detail below with respect to FIG. 3.

In addition, system 100 may comprise or otherwise be implemented in a mobile device. The mobile device 105 may comprise, but is not limited to, a mobile telephone, a cellular telephone, a wireless telephone, a wireless device, a hand-held personal computer, a hand-held computing device, a multi-processor system, a micro-processor-based or programmable consumer electronic device, a personal digital assistant (PDA), a telephone, a pager, or any other device configured to receive, process, and transmit information. For example, the mobile device may comprise an electronic device configured to communicate wirelessly and be small enough for a user to carry the electronic device easily. In other words, the mobile device may be smaller than a notebook computer and may comprise a mobile telephone or PDA, for example.

Figure 2:
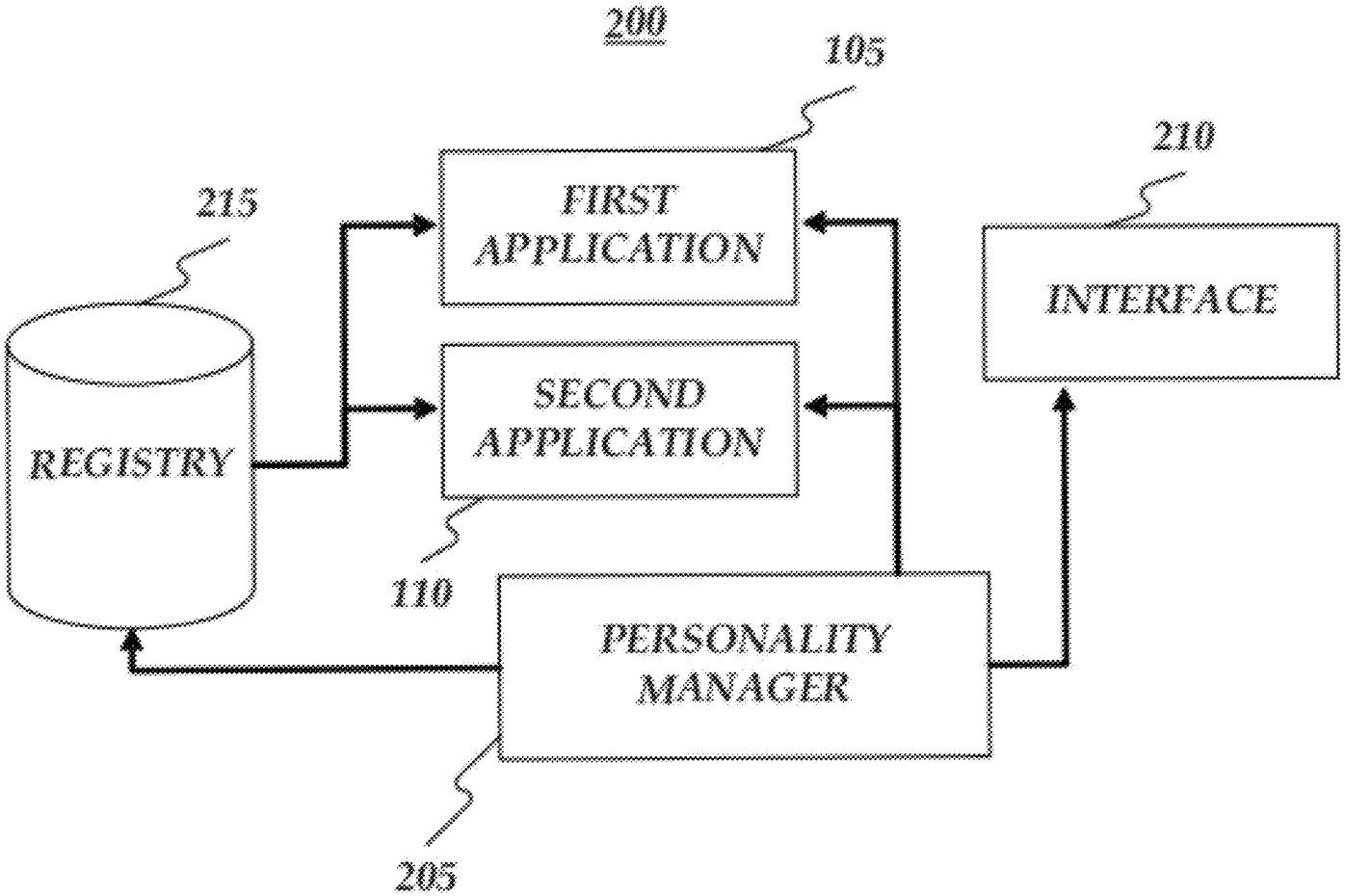
FIG. 2 is a block diagram of another operating environment.

FIG. 2 shows a personality-based theme management system 200. As shown in FIG. 2, system 200 may include, but not limited to first application program 105, second application program 110, a personality manager 205, an interface 210, and a registry 215. As described in greater detail below with respect to FIG. 4, system 200 may be implemented using system 400. The operation of FIG. 2 will be described in greater detail below.

Figure 3:
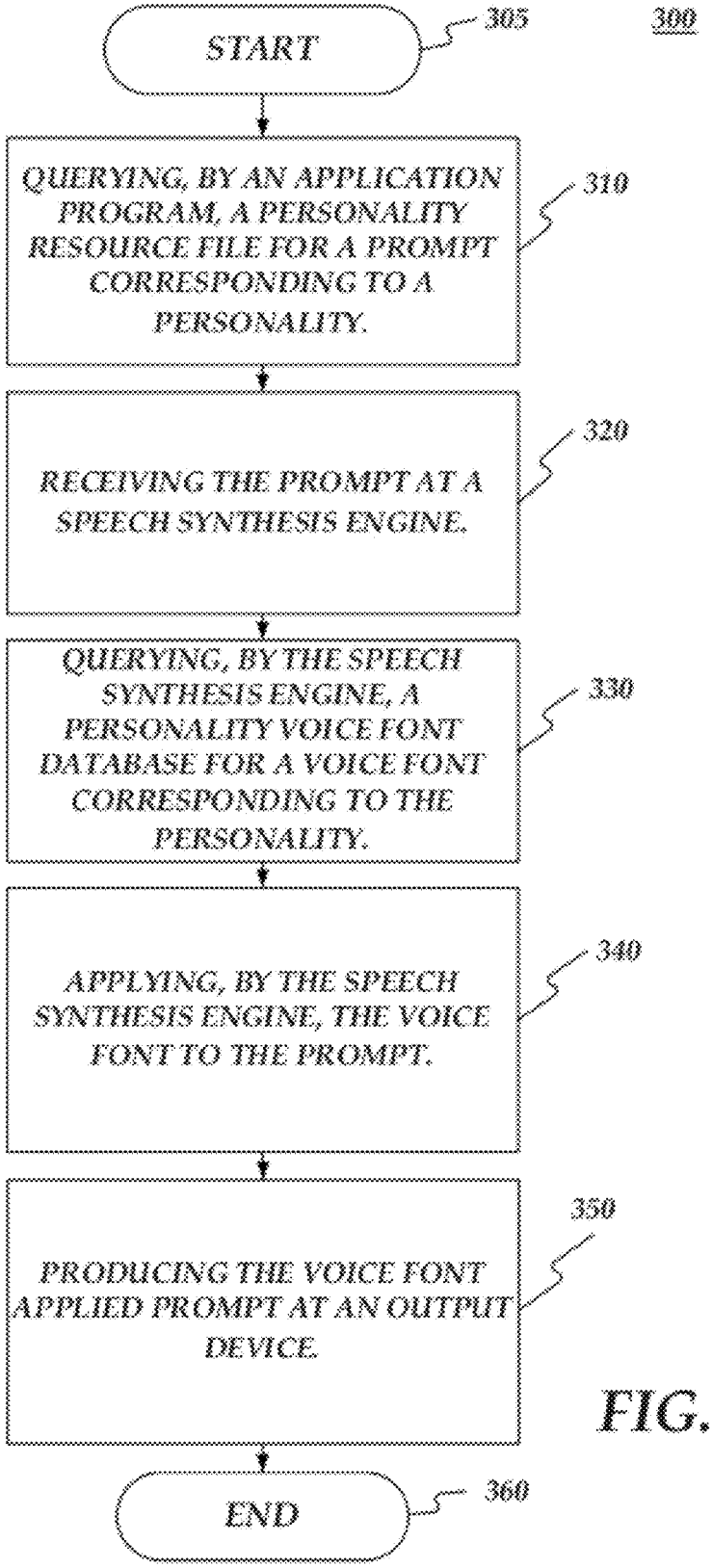
FIG. 3 is a flow chart of a method for providing a personality-based theme.

FIG. 3 is a flow chart setting forth the general stages involved in a method 300 consistent with an embodiment of the invention for providing a personality-based theme. Method 300 may be implemented using a computing device 400 as described in more detail below with respect to FIG. 4. Ways to implement the stages of method 300 will be described in greater detail below. Method 300 may begin at starting block 305 and proceed to stage 310 where computing device 400 may query (e.g. by first application program 105 in response to a user initiated input,) first personality resource file 120 for a prompt corresponding to a personality. For example, first application program 105 prompts may be stored in first personality resource file 120. Each speech application (e.g. first application program 105, second application program 110, third application program 115, etc.) may provide a personality-specific resource file for each personality skin. If a speech application chooses not to provide a personality-specific resource file for a given personality, a default resource file (e.g. first default resource file 125, third default resource file 135) may be used. The personality-specific resource files may be provided with each personality skin package. When installed, the personality skin package may install the new resource file for each application.

From stage 310, where computing device 400 queries first personality resource file 120, method 300 may advance to stage 320 where computing device 400 may receive the prompt at speech synthesis engine 140. For example, first application program 105, second application program 110, or third application program 115 may provide the prompt to speech synthesis engine 140 through speech service 145.

Once computing device 400 receives the prompt at speech synthesis engine 140 in stage 320, method 300 may continue to stage 330 where computing device 400 (e.g. speech synthesis engine 140) may query personality voice font database 150 for a voice font corresponding to the personality. For example the voice font may be created based on recordings of the personality's voice. In addition, the voice font may be configured to make the prompt sound like the personality when produced. In order to implement the customized voice feature of a personality skin, speech synthesis (or text-to-speech) engine 140 may be used. A voice font may be created for the target individual by processing a series of recordings made by that target individual. Once the font has been created it may be used by synthesis engine 140 to produce speech that sounds like the desired target individual.

After computing device 400 queries personality voice font database 150 in stage 330, method 300 may proceed to stage 340 where computing device 400 (e.g. speech synthesis engine 140) may apply the voice font to the prompt. For example, applying the voice font to the prompt may further comprise augmenting the voice font applied prompt with recorded phrases of the personality (e.g. target individual). In addition, the prompt may be altered to conform with a grammatical style of the personality (e.g. target individual).

While synthesized speech may sound acoustically like the target individual, the words used by system 100 for dialogs or notifications, may not accurately reflect the speaking style of target individual. In order to more closely match the speaking style of the target individual, applications (e.g. first application program 105, second application program 110, third application program 115, etc.) may also choose to alter the specific messages (e.g. prompts) to be spoken, such that they use the words and prosody characteristics the device user may expect the target individual to use. These alterations may be made by changing the phrases to be spoken (including prosody tags). Each speech application may need to make these alterations for their respective spoken prompts.

Once computing device 400 applies the voice font to the prompt in stage 340, method 300 may proceed to stage 350 where computing device 400 may produce the voice font applied prompt at output device 160. For example, output device 160 may be disposed within a mobile device. Output device 160 may, for example, comprise any of output devices 414 as described in more detail below with respect to FIG. 4. Once computing device 400 produces the voice font applied prompt at output device 160 in stage 350, method 300 may then end at stage 360.

A system that may support personality skin packages may include a "personality skin manager." As stated above, FIG. 2 shows a personality-based theme management system 200. Personality-based theme management system 200 may provide interface 210 that may allow users, for example, to switch between personality skins, to remove installed personality skin packages, and to purchase and download new personality skin packages.

First application 105 and second application 110 may load the appropriate resource file depending on the current voice font. The current voice font may be made available to first application 105 or second application 110 at runtime through a registry key. Additionally, personality manager 205 may notify first application 105 or second application 110 when the current skin (and thereby the current voice font) is updated. Upon receiving this notification, first application 105 or second application 110 may reload their resources as appropriate.

In addition to the customization of prompts, application designers may wish to customize speech recognition (SR) grammars, so the end user can issue voice commands in the speaking style of the target individual, or to address the device by the name of the individual. Such grammar updates may be stored and delivered in resource files in a manner similar to the customized prompts described above. These grammar updates may be particularly important in the multiple-personality scenario described below.

Besides managing the speech components of the personality skin package (voice font, prompts, and possibly grammars), personality manager 205 may also manage the visual and audio components of the personality skin such that when a user switched to a different personality skin, the look and sound of the device may update along with its voice. Some possible actions could include, but are not limited to, updating the background image on the device and setting a default ring tone.

Consistent with embodiments of the invention, the personality concept can also be extended such that a single device could portray multiple personalities. Consequently, supporting multiple personalities at one time may require additional RAM, ROM, or processor resources. Multiple personalities may extend the concept of a personality-based device in a number of ways. As described above, multiple personality skins may be stored on a device and may be selected at runtime by the end user or changed automatically by personality manager 205 based on a generated or user-defined schedule. In this scenario, only additional ROM may be required to store the inactive voice font databases and application resources. This approach may also be used to allow the device to change moods as a particular mood for an individual could be portrayed through a mood-specific personality skin. Applying moods to the device personality could make the device more entertaining and could also be used to convey information to the end user (for example, the personality skin manager could switch to a "sleepy" mood when the device battery becomes low).

Consistent with multiple personality embodiments of the invention, more than one personality may be active at a time. For example, each personality may be associated with a feature or set of features on the device. Then the end user may interact with a feature (e.g. e-mail) or a set of features (e.g. communications) by interacting with the associated personality. This approach may also help to restrain grammars if the user addresses the device by the name of the personality associated with the functionality he or she wants to interact with (e.g. "Shawn, what's my battery level?", "Geena, what's my next appointment?") Furthermore, when the user gets notifications from the device, the voice used may indicate to the user to which functional area the message belongs. For example, the user may be able to tell that a notification is related to e-mail because he or she recognizes the voice as belonging to the personality associated with e-mail notifications. The system architecture may changes slightly in this situation, because applications may specify the voice to be used for the device's notifications. Personality manager 205 may assign the voice that each application may use and the application may need to speak using the appropriate engine instance.

An embodiment consistent with the invention may comprise a system for providing personality-based theme. The system may comprise a memory storage and a processing unit coupled to the memory storage. The processing unit may be operative to query, by an application program, a personality resource file for a prompt corresponding to a personality and to receive the prompt at a speech synthesis engine. In addition, the processing unit may be operative to query, by the speech synthesis engine, a personality voice font database for a voice font corresponding to the personality. Moreover, the processing unit may be operative to apply, by the speech synthesis engine, the voice font to the prompt and to produce the voice font applied prompt at an output device.

Another embodiment consistent with the invention may comprise a system for providing personality-based theme. The system may comprise a memory storage and a processing unit coupled to the memory storage. The processing unit may be operative to produce at least one audio content corresponding to a predetermined personality and to produce at least one video content corresponding to the predetermined personality.

Yet another embodiment consistent with the invention may comprise a system for providing personality-based theme. The system may comprise a memory storage and a processing unit coupled to the memory storage. The processing unit may be operative to receive, at a personality manager, a user initiated input indicating a personality and to notify at least one application of the personality. Moreover, the processing unit may be operative to receive a personality resource file in response the at least one application requesting the personality resource file in response to the at least one application being notified of the personality.

Figure 4:
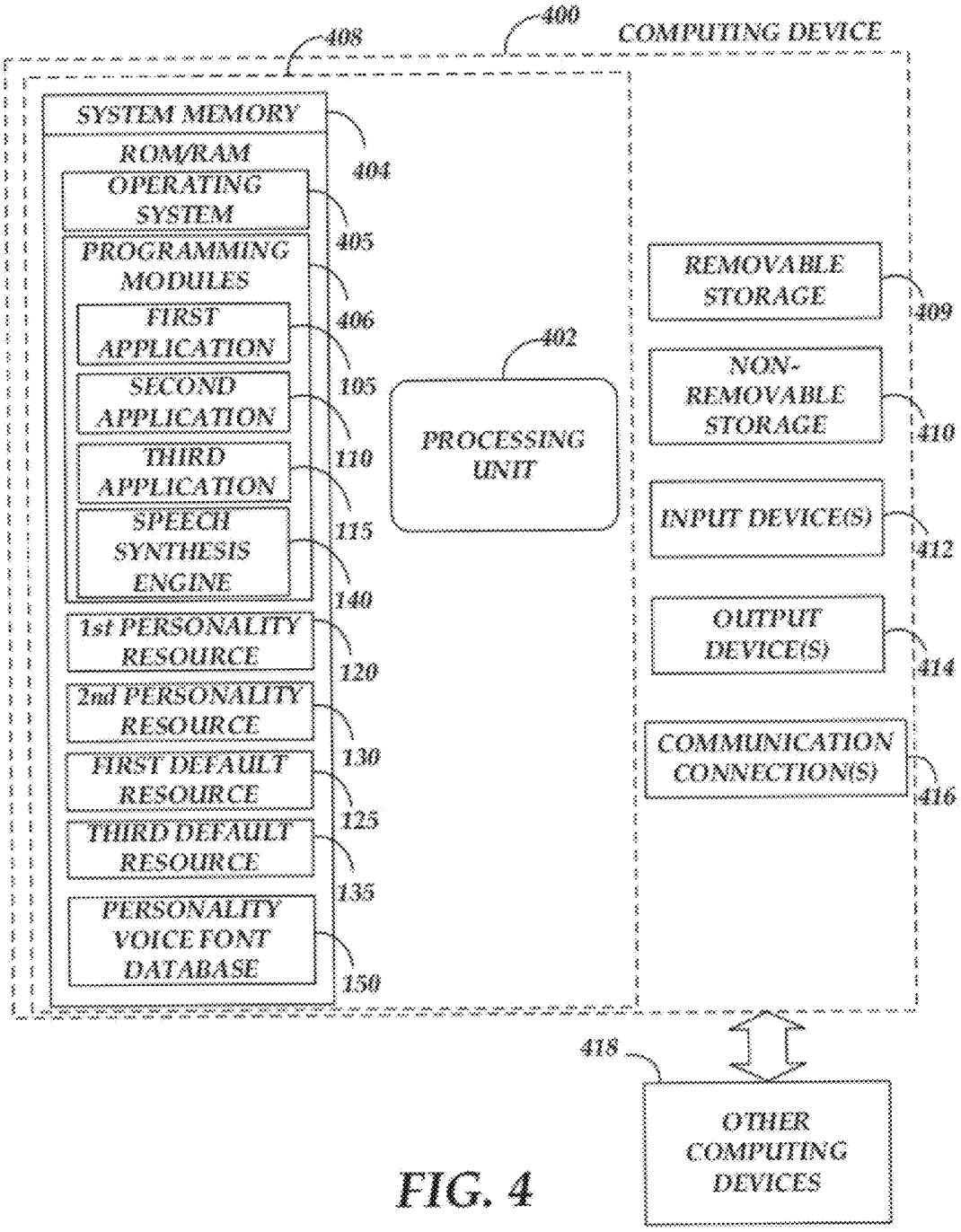
FIG. 4 is a block diagram of a system including a computing device.

FIG. 4 is a block diagram of a system including computing device 400. Consistent with an embodiment of the invention, the aforementioned memory storage and processing unit may be implemented in a computing device, such as computing device 400 of FIG. 4. Any suitable combination of hardware, software, or firmware may be used to implement the memory storage and processing unit. For example, the memory storage and processing unit may be implemented with computing device 400 or any of other computing devices 418, in combination with computing device 400. The aforementioned system, device, and processors are examples and other systems, devices, and processors may comprise the aforementioned memory storage and processing unit, consistent with embodiments of the invention. Furthermore, computing device 400 may comprise an operating environment for systems 100 and 200 as described above. Systems 100 and 200 may operate in other environments and is not limited to computing device 400.

With reference to FIG. 4, a system consistent with an embodiment of the invention may include a computing device, such as computing device 400. In a basic configuration, computing device 400 may include at least one processing unit 402 and a system memory 404. Depending on the configuration and type of computing device, system memory 404 may comprise, but is not limited to, volatile (e.g. random access memory (RAM)), non-volatile (e.g. read-only memory (ROM)), flash memory, or any combination. System memory 404 may include operating system 405, one or more programming modules 406, and may include a program data such as first personality resource file 120, first default resource file 125, second personality resource file 130, third default resource file 135, and personality voice font database 150. Operating system 405, for example, may be suitable for controlling computing device 400's operation. In one embodiment, programming modules 406 may include first application program 105, second application program 110, third application program 115, and speech synthesis engine 140. Furthermore, embodiments of the invention may be practiced in conjunction with a graphics library, other operating systems, or any other application program and is not limited to any particular application or system. This basic configuration is illustrated in FIG. 4 by those components within a dashed line 408.

Computing device 400 may have additional features or functionality. For example, computing device 400 may also include additional data storage devices (removable and/or non-removable) such as, for example, magnetic disks, optical disks, or tape. Such additional storage is illustrated in FIG. 4 by a removable storage 409 and a non-removable storage 410. Computer storage media may include volatile and nonvolatile, removable and non-removable media implemented in any method or technology for storage of information, such as computer readable instructions, data structures, program modules, or other data. System memory 404, removable storage 409, and non-removable storage 410 are all computer storage media examples (i.e. memory storage). Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 400. Any such computer storage media may be part of device 400. Computing device 400 may also have input device(s) 412 such as a keyboard, a mouse, a pen, a sound input device, a touch input device, etc. Output device(s) 414 such as a display, speakers, a printer, etc. may also be included. The aforementioned devices are examples and others may be used.

Computing device 400 may also contain a communication connection 416 that may allow device 400 to communicate with other computing devices 418, such as over a network in a distributed computing environment, for example, an intranet or the Internet. Communication connection 416 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 404, including operating system 405. While executing on processing unit 402, programming modules 406 (e.g. first application program 105, second application program 110, third application program 115, and speech synthesis engine 140) may perform processes including, for example, one or more method 300's stages as described above. The aforementioned process is an example, and processing unit 402 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip containing electronic elements or microprocessors. Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems. Moreover, embodiments of the invention may also be practiced in conjunction with technologies such as Instant Messaging (IM), SMS, Calendar, Media Player, and Phone (caller-ID).

Embodiments of the invention, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present invention may be embodied in hardware and/or in software (including firmware, resident software, micro-code, etc.). In other words, embodiments of the present invention may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present invention, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the invention have been described, other embodiments may exist. Furthermore, although embodiments of the present invention have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the invention.

All rights including copyrights in the code included herein are vested in and the property of the Applicant. The Applicant retains and reserves all rights in the code included herein, and grants permission to reproduce the material only in connection with reproduction of the granted patent and for no other purpose.

While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A method for providing a personality-based theme, the method comprising:

receiving a prompt;

receiving an input indicating a personality;

determining a voice font corresponding to the personality; and applying the voice font to the received prompt wherein applying the voice font to the prompt further comprises augmenting the voice font applied prompt with recorded phrases of the personality.

2. The method of claim 1, wherein receiving the input indicating the personality comprises receiving the input from a user.

3. The method of claim 1, wherein receiving the prompt comprises receiving the prompt from a user.

4. The method of claim 3, further comprising producing the voice font applied prompt at an output device.

5. The method of claim 4, wherein producing the voice font applied prompt at the output device comprises producing the voice font applied prompt at the output device disposed within a mobile device.

6. The method of claim 3, further comprising altering the prompt to conform with a grammatical style of the personality.

7. The system of claim 6, wherein at least a portion of an exterior of the system comprises a cover associated with the predetermined personality.

8. The method of claim 1, wherein determining the voice font comprises querying a personality voice font database for the voice font, the voice font being created based on recordings the personality's voice.

9. The method of claim 8, wherein querying the personality voice font database for the voice font comprises querying the personality voice font database for the voice font configured to make the prompt sound like the personality when produced.

10. A system for providing a personality-based theme, the system comprising:

a memory storage; and a processing unit coupled to the memory storage, wherein the processing unit is operative to:

receive an input indicating a personality;

determine a voice font associated with the personality; and produce audio content corresponding to the personality with the voice font wherein the audio content comprises a synthesized voice configured to sound like the personality, the synthesized voice being altered to conform with a grammatical style of the predetermined personality.

11. The system of claim 10, further comprising the processing unit being operative to produce graphical content corresponding to the personality.

12. The system of claim 11, wherein the graphical content comprises at least one of the following: an image associated with the predetermined personality and a video clip associated with the predetermined personality.

13. The system of claim 11, wherein the graphical content comprises at least one of the following: an object associated with the personality, a likeness of the personality, and a color scheme associated with the personality, video content performed by the personality, video content composed by the personality, video content written by the predetermined personality, video content recorded by the predetermined personality, video content associated with a movie associated with the predetermined personality, and video content associated with a television program associated with the personality.

14. The system of claim 10, wherein the audio content comprises a ring tone.

15. The system of claim 10, wherein the audio content comprises content recorded from the personality.

16. The system of claim 10, wherein the audio content comprises at least one of the following: sound content performed by the personality, sound content composed by the personality, sound content written by the personality, sound content recorded by the personality, sound content associated with a movie associated with the personality, and sound content associated with a television program associated with the personality.

17. A method for providing a personality-based theme, the method comprising:

receiving an input indicating a personality;

determining a voice font associated with the personality; and producing audio content corresponding to the personality with the voice font wherein the audio content comprises a synthesized voice configured to sound like the personality, the synthesized voice being altered to conform with a grammatical style of the predetermined personality.

18. The method of claim 17, further comprising producing graphical content corresponding to the personality.

19. The method of claim 17, wherein producing the audio content comprises producing the audio content comprising a ring tone.

20. The method of claim 17, wherein producing the audio content comprises producing the audio content recorded from the personality.

* * * * *